US006299479B1

(12) United States Patent
Tang

(10) Patent No.: US 6,299,479 B1
(45) **Date of Patent: *Oct. 9, 2001**

(54) F-CONNECTOR ASSEMBLY

(76) Inventor: Danny Q. Tang, 2 Taylorr Lake Ct., Manalapan, NJ (US) 07726

( * ) Notice: Subject to any disclaimer, the term of this patent is extended or adjusted under 35 U.S.C. 154(b) by 5 days.

This patent is subject to a terminal disclaimer.

(21) Appl. No.: 09/664,457

(22) Filed: Sep. 18, 2000

(51) Int. Cl.[7] ..... H01R 9/05

(52) U.S. Cl. ..... 439/578; 439/584; 439/581; 439/63

(58) Field of Search ..... 439/578, 584, 439/63, 581

(56) References Cited

U.S. PATENT DOCUMENTS

| | | | | |
|---|---|---|---|---|
| 3,678,444 | * | 7/1972 | Stevens et al. | 339/130 C |
| 3,686,623 | | 8/1972 | Nijman | 439/584 |
| 3,761,870 | | 9/1973 | Drezin et al. | 439/584 |
| 3,854,789 | | 12/1974 | Kaplan | 439/584 |
| 4,346,958 | | 8/1982 | Blanchard | 439/584 |
| 4,447,107 | | 5/1984 | Major, Jr. et al. | 439/584 |
| 4,676,577 | | 6/1987 | Szegda | 439/584 |
| 6,071,144 | * | 6/2000 | Tang | 439/426 |

* cited by examiner

*Primary Examiner*—Paula Bradley
*Assistant Examiner*—Sean McCamey
(74) *Attorney, Agent, or Firm*—Kenneth Watov; Watov & Kipnes, P.C.

(57) ABSTRACT

A female connector assembly for an electrically conductive coaxial cable, comprises an electrically conductive barrel shaped body having a top end with a centrally located hole forming an input port, and a bottom end configured for connecting with a portion of a housing of an electrical device. An electrically insulative hollow sleeve consisting of two interlocking cap members encloses an electrically conductive clip pin, and is contained within the body of the connector. The sleeve and clip pin are securely held within the body via connection of the body to a housing of an electrical device, and rigid attachment of an elongated pin extending from the sleeve, through a hole in the housing, to electrical circuitry within the housing.

14 Claims, 10 Drawing Sheets

F-CONNECTOR ASSEMBLY

FIELD OF THE INVENTION

The present invention relates generally to F-connector assemblies for coaxial cables, and more particularly to improved ground shielding contact F-connector assemblies for coaxial cables.

BACKGROUND OF THE INVENTION

In cable television systems a standard connector configuration, particularly with regard to the outer shell and mounting threads, is known as an F-connector, for connection to a 75 ohm coaxial cable, for example. The F-connector comes in many configurations, depending upon the application at hand. Typically, the main body or outer shell of the F-connector is in the form of a barrel with a hollow throughhole connecting the opposed openings at each end thereof, and is typically composed of an electrically conducting material such as brass. The F-connector outer shell includes an input end, a mounting end and a set of external threads extending therearound. The threads of the F-connector are standard UNF threads. The mounting end of the outer shell is generally configured for attachment to an electrical device housing or a coverplate of the electrical device housing through solid casting or threaded engagement, for example. In certain applications the exterior portion of the outer shell near the mounting end may not be threaded, but configured for press fitting into a hole in the electrical device housing. The threads further permit the cap of a mating male coaxial cable connector to be securely threaded onto the top of the outer shell over the input end of the connector for a secure connection therebetween The F-connector further includes an inner housing composed of an insulating material located within the throughhole of the outer shell. The inner housing comprises an upper cap and a lower cap. The top of the lower cap is configured for sliding engagement into the bottom of the upper cap to form a chamber therein with opposed openings at each end coaxial with the openings of the outer shell. A female connector pin is disposed within the inner housing chamber and is electrically isolated from the F-connector outer shell. To retain the upper and lower caps and the female connector pin within the F-connector outer shell, an edge portion of the outer shell at the input end is effectively peened or rolled radially inward under pressure against the associated components contained therein.

To provide effective electrical connection, one end of the female pin is configured for receiving and electrically linking with a center pin of a coupled male connector extending into the chamber through the opening at the input end. The other end of the female pin includes an end prong protruding from the mounting end of the F-connector. The end prong of the female pin is electrically connected to an internal circuit housed within the electrical device housing and conducts RF signals, and also AC power in certain applications between the coupled male coaxial cable connector and the internal circuit. Additionally, the coupling of the F-connector and the male coaxial cable connector further foils a ground connection between the F-connector outer shell and the shielding sleeve of the coaxial cable to minimize undesirable signal leakage and radio frequency interference from the outside.

Recent industry-wide standards have required the fabrication and use of a wider and flatter edge portion at the input end of the outer shell to achieve the best flush contact with the male coaxial cable connector for purposes of gaining the most optimal electrical ground connection. The peening or rolling technique used currently produces an undesirable narrow curvilinear surface along the edge portion at the input end. Although it is possible to produce peened edge portions with substantially flat and wide ries, F-connectors having such substantially flat peened edge portions are more expensive to fabricate, and experience greater structural failure rates due in part to increased occurrences of metal fractures and fatigue introduced by the peening process. Another approach in fabricating the flat edge surface is to slightly compress radially the input end opening without rounding the edge surface. To minimize metal fracture and fatigue, the amount of compression forged is very limited and slight. Such F-connectors possess limited retainment capacity of the internal components. At elevated temperatures, the outer shell and the input end opening has a tendency to expand in a manner to permit the internal components of the F-connector to exit the outer shell.

For the foregoing reasons, there is a need for an improved F-connector assembly which can provide a substantially flat top edge portion along an input end opening thereof while in a cost efficient manner, maintaining reliable retaimnent of the associated internal components therein for effective long term operation.

SUMMARY OF THE INVENTION

With the prior art problems in mind, the present invention is generally directed to an F-connector assembly for coaxial cables which is cost efficient, easy to fabricate and implement, and adaptable for connection with a coaxial cable in a mamer providing reliable long term operation.

In particular, one aspect of the present invention is directed to an F-connector assembly which comprises:

a) a barrel shaped casing having a top end with a centrally located hole forming an input port, and a bottom end configured fbr connecting with a portion of a housing of an electrical device, said casing being configured for mechanical retainment and electrical connection with a coaxial cable connecting element;

b) a top cap and a bottom cap each configured for locking engagement to form a hollow enclosed sleeve, said sleeve being disposed within said casing, said hollow enclosed sleeve including a first opening coaxially positioned with said top end hole, a second opening on the opposing end in communication with an interior volume of said housing and a hollow core therebetween; and c) a clip pin securely retained within the hollow core of said hollow enclosed sleeve, said clip pin including a contact mechanism at one end for receiving and retaining a coaxial cable center conductor passing through the open end of said port, and a conducting pin at an opposing end, extending from the hollow core through the second opening of the hollow sleeve into said housing interior volume and rigidly being anchored therein for electrical connection to internal electric circuit.

BRIEF DESCRIPTION OF THE DRAWINGS

Various embodiments of the invention are described in detail below with reference to the drawings, in which like items are identified by the same reference designation, wherein.

DETAILED DESCRIPTION OF THE INVENTION

The present invention is generally directed to an F-connector assembly constructed in a manner that provides over the prior art improved electrical ground contact with a mating male connector and its associated ground shield of a coaxial cable attached thereon. The present F-connector assembly is constricted with the advantage of reliable retainment and operation of the internal components over time and over repeated use, and ease of fabrication using known available manufacturing methods In addition, the present F-connector assembly may be constructed in a manner which allows easy ready replacement of internal components of one F-connector assembly unit without disrupting undamaged F-connector units. The cost efficient and effective manner by which the F-connector assembly is constructed and by which the present F-connector assembly meets the requirements of an improved ground contact with coaxial cables as set forth by industry-wide standards makes such F-connector assemblies especially suitable for telecommunication use.

Figure 1:
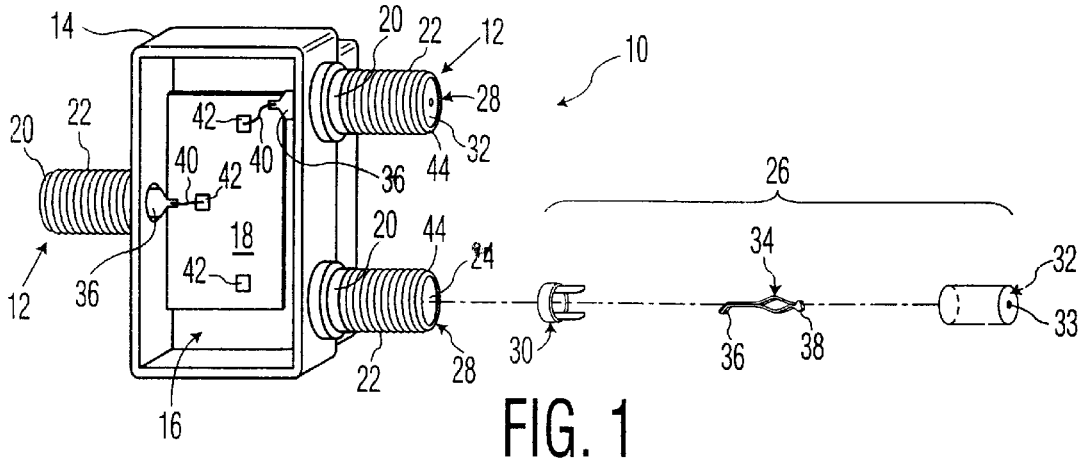
FIG. 1 PRIOR ART
FIG. 1 is an exploded assembly diagram of a standard signal splitter device and an F-connector assembly of the prior art.

FIG. 1 shows a typical prior art configuration of an electrical device 10 (i.e. signal splitter without its cover) upon which a plurality of F-connector assemblies 12 of the prior art are mounted. The electrical device 10 includes an electrically conductive metal housing 14 with interior volume 16, internal electrical circuitry on a printed circuit board 18, and the plurality of F-connector assemblies 12 utilized as input/output connections, respectively, for coupling with coaxial cables via male coaxial cable connector (not shown).

The F-connector assembly 12 generally comprises a barrel-shaped or cylindrical electrically conductive metal body 20 with a set of eternal threads 22 extending therearound, a through hole 24 in communication with the interior volume 16 of the electrical device housing 14, and an internal connection assembly 26. The body 20 includes a free end approximate 28 opening for coupling with a male coaxial cable connector with the opposing end of body 20 being mechanically and electrically connected to the housing 14 via, for example, as a unitary casting with housing 14, or by threaded engagement or press fitting, or welding techniques, and so forth as known in the art. The threads 22 are standard UNF threads, in this example. The threads 22 permit the cap of a mating male connector to be securely screwed onto the top of the body 20 over the coupling end thereof. It is noted that although the body 20 typically consists of alloy material, or any other suitable, such as aluminum alloy or brass, and must be electrically conductive for providing the ground termination for the coaxial cable secured thereto, materials other dim brass can be used.

The internal connection assembly 26 provides electrical connection between the center conductor of a coaxial cable (not shown) via the associated mating male connector (not shown), and the internal circuitry 18 within the housing 14 for conducting RF signals, and AC power (if any) therebetween The internal connection assembly 26 is located in the through hole 24 of the body 20, and includes a bottom cap 30, a top cap 32, and a clip pin 34. The bottom cap 30 is configured to slip fit into the top cap 32, to form an electrically insulating enclosure for the clip pin 34. The clip pin 34 includes a tail portion 36 at one end and a pair of opposing spring contacts 38 for clasping the center conductor of a coaxial cable associated with a mating male connector at the other end. The tail portion 36 of the clip pin 34 is adapted to extend through an opening (not shown) of the bottom cap 30. A centrally located opening 33 is provided in the top cap 32 for permitting insertion of the center conductor of a coaxial cable therethrough during connection of the male connector.

To assemble the F-connector assembly 12, the various components as described are slid into the body 20 through the opening 28 thereof with the tail portion 36 introduced first into the internal volume 16 of the chassis 14. The tail portion 36 of the clip pin 34 is rigidly mechanical and electrically connected to the internal circuitry 18 preferably by soldering directly to a terminal 42, or through a soldered wire 40. An edge portion 44 around the opening 28 is bent or peened radially inward for securing the various component elements of the F-connector assembly 12 in place.

Figure 2:
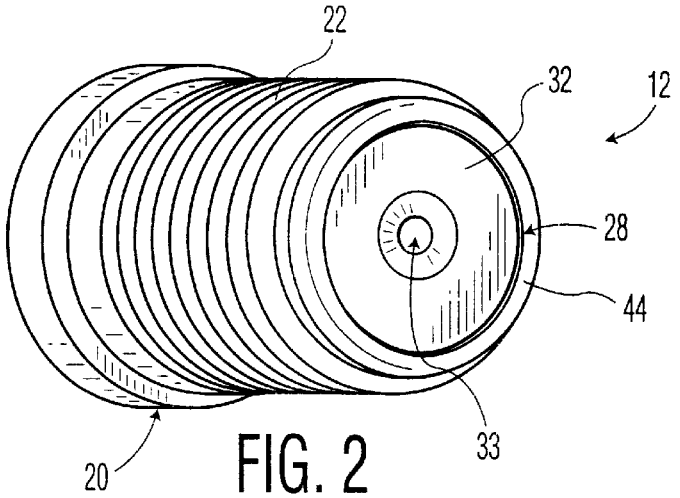
FIG. 2 PRIOR ART
FIG. 2 is a pictorial view of the front end of an assembled F-connector assembly of FIG. 1.

With reference to the pictorial view of FIG. 2 for the F-connector assembly 12, note the peened edge portion 44 extending around the opening 28 in an attempt to prevent the various internal components from being released from the body 20, has a facial surface that is narrow and blunt, providing a negligible ground connection between the body 20 and the ground shield of the connecting coaxial cable via mechanical connection to a mating male connector. Industry-accepted standards now require the use of a wide, flat edge portion 44 to provide an improved electrical ground contact between the F-connector assembly, and male coaxial cable connector. However, fabricating an F-connector assembly with such a flat edge portion is difficult and expensive. Peening techniques are limited and may cause metal fatigue and deformation.

Figure 3:
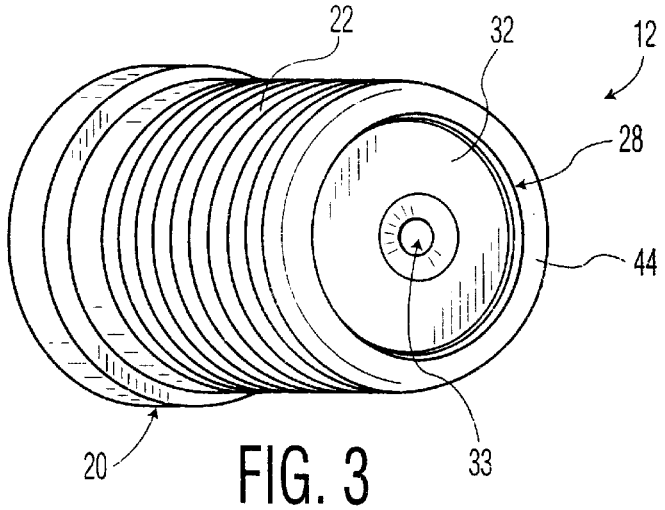
FIG. 3 PRIOR ART
FIG. 3 is a pictorial view of the assembled F-connector assembly of FIG. 2 showing the effects of elevated ambient temperature.

With reference to FIG. 3, a wider edge portion 44 is provided by very slightly compressing the edge portion 44 radially inward for sufficiently retaining the components therein. However, such F-connector assemblies 12 suffer from retainment failure. During elevated temperatures, the thermal expansion gradient of the body 20 may be such that the opening 28 expands and a gap or spacing between the edge portion 44 and the outer edge of the top cap 32 is created, thus resulting in the loss of retention of the internal components, such as top cap 32.

Figure 4:
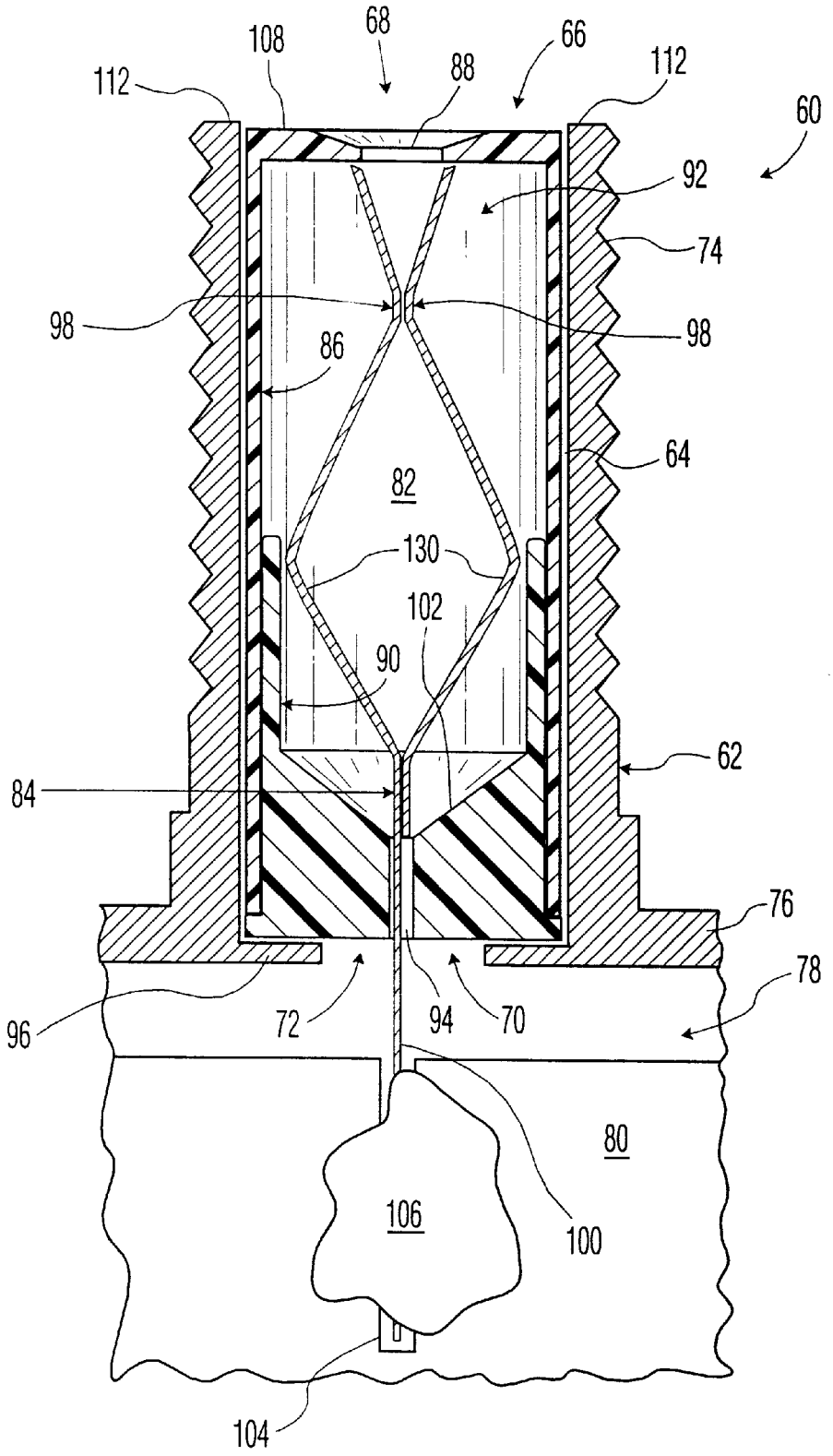
FIG. 4 is a longitudinal cross sectional view of an F-connector assembly of the present invention.
Figure 5:
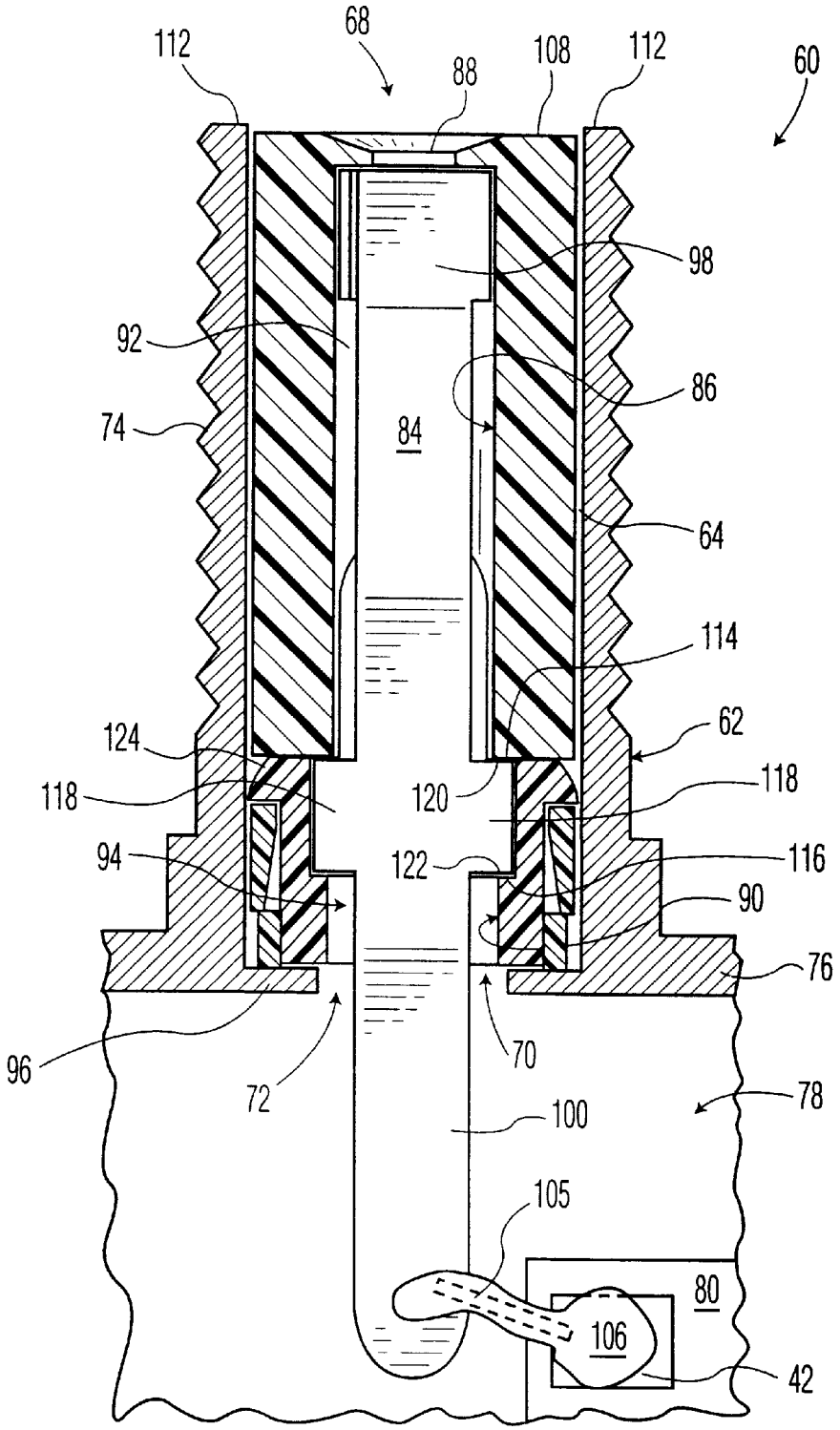
FIG. 5 is a longitudinal cross sectional view of the F-connector assembly of FIG. 4 rotated 90° counterclockwise.

FIGS. 4 and 5 illustrate two embodiments, respectively, of an F-connector assembly in accordance with the present invention, that overcomes the problems in the prior art. The F-connector assembly is generally denoted by the reference numeral 60, and includes a hollow outer shell or body 62 with a through hole 64 disposed between an input opening 66 at an input end 68 and a base opening 70 proximate a base end 72 thereof, and a set of external threads 74 extending around the exterior portion thereof. The outer shell 62 is preferably composed of an electrically conductive material such as zinc alloy, aluminum alloy, or brass, for example. It is noted that a given electrical device typically includes at least a plurality of F-connector assemblies 60 for multiple inputs and/or outputs, respectively, as may be required for a given application.

The hollow outer body 62 is part of or mechanically and electrically attached to the metal wall of a chassis or housing 76 or some other housing of an electrical device having circuitry which is to be connected to a coaxial cable. The body 62 is preferably grounded for providing continuous shielding of the RF signals and any AC power transmitted between the coaxial cable and the associated electrical/electronic components housed within the electrical device. The length and size of the outer shell 62 and the internal components contained therein may vary, as desired, depending on the application and the specification required for installation and implementation of the invention as well as the configuration of the coaxial cable and/or the male connector for coupling therewith.

The term "electrical device" includes, but is not limited to multi-taps, signal conditioners, receivers, encoders/decoders, amplifiers, splitters, junction boxes and the like which may be located at either end of a run of a coaxial cable or at any other location therebetween.

The input end 68 of the outer shell 62 is configured for coupling with the coaxial cable/male connector (not shown) through the input opening 66 by threaded engagement therebetweem The means of engagement is not limited to those involving screwthreads, and may include other forms as known to one of ordinary skill in the art The base end 72 of the outer shell 62 is configured for attachment to the electrical device chassis 76. In this example, the shell or body 62 and chassis 76 are formed from a single unitary metal casting. It is also understood that the attachment means is not limited to this firm only, and may include other forms which provide mechanical and electrical connection therebetween such as threaded means, press fitted means, welded means and the like as known to one of ordinary skill in the art. The through hole 64 of the outer shell 62 is in communication with a interior volume 78 of the electrical device chassis 76 including electrical circuitry 80 housed therein, in this example.

The F-connector assembly 60 further includes an electrically insulated inner housing 82, and a clip pin 84 securely retained therein. The inner housing 82 comprises an upper cap member 86 with a centrally located beveled hole 88 proximate the input end 68 of the outer shell 62, and a lower cap member 90 being configured for fitting partially within and slidably engaging an interior lower portion of the upper cap member 86 to form an electrically insulated chamber 92 for retaining the electrically conductive clip pin 84. Clip pin 84 is typically fabricated from phosphorbronze, or beryllium copper, of other suitable material. The lower cap member 90 includes a centrally located slot 94 proximate the base end 72 of the outer shell 62. The inner housing 82 is preferably composed of a durable electrically insulating material including, but not limited to, plastic, polypropylene, Duron®, and so forth. A ledge portion 96 extending around the base opening 70 is provided for retaining the inner housing and clip pin assembly within the through hole or cavity 64, as shown. In a preferred embodiment, the lodge portion 96 is annular.

The clip pin 84 includes a pair of opposable spring contacts 98 at one end, located proximate the hole 88 of the upper cap member 86 for grasping a portion of a center conductor of the coaxial cable during coupling, and a tail or elongated tab portion 100 at an opposing end thereof. The lower cap member 90 includes downwardly converging side portions 102 extending to the slot 94 hereof for assisting in assembly by facilitating passing of the tail portion 100 through the slot 94 into the interior volume 78 of the chassis 76. The internal circuitry 80 includes in the embodiment of FIG. 4, a terminal lead in the form of a narrow slot 104 which receives the projecting tail portion 100 of the clip pin, whereby a weld or solder 106 is employed to provide an electrical connection and a secure mechanical retainment therebetween.

With reference to FIG. 4, the upper cap member 86 further includes an outer annular top portion 108 extending around the centrally located beveled hole 88. A flat top face annular surface 112 is provided for forming the most optimal ground contact with the inside face of a mated male coaxial cable connector (not shown).

Figure 6:
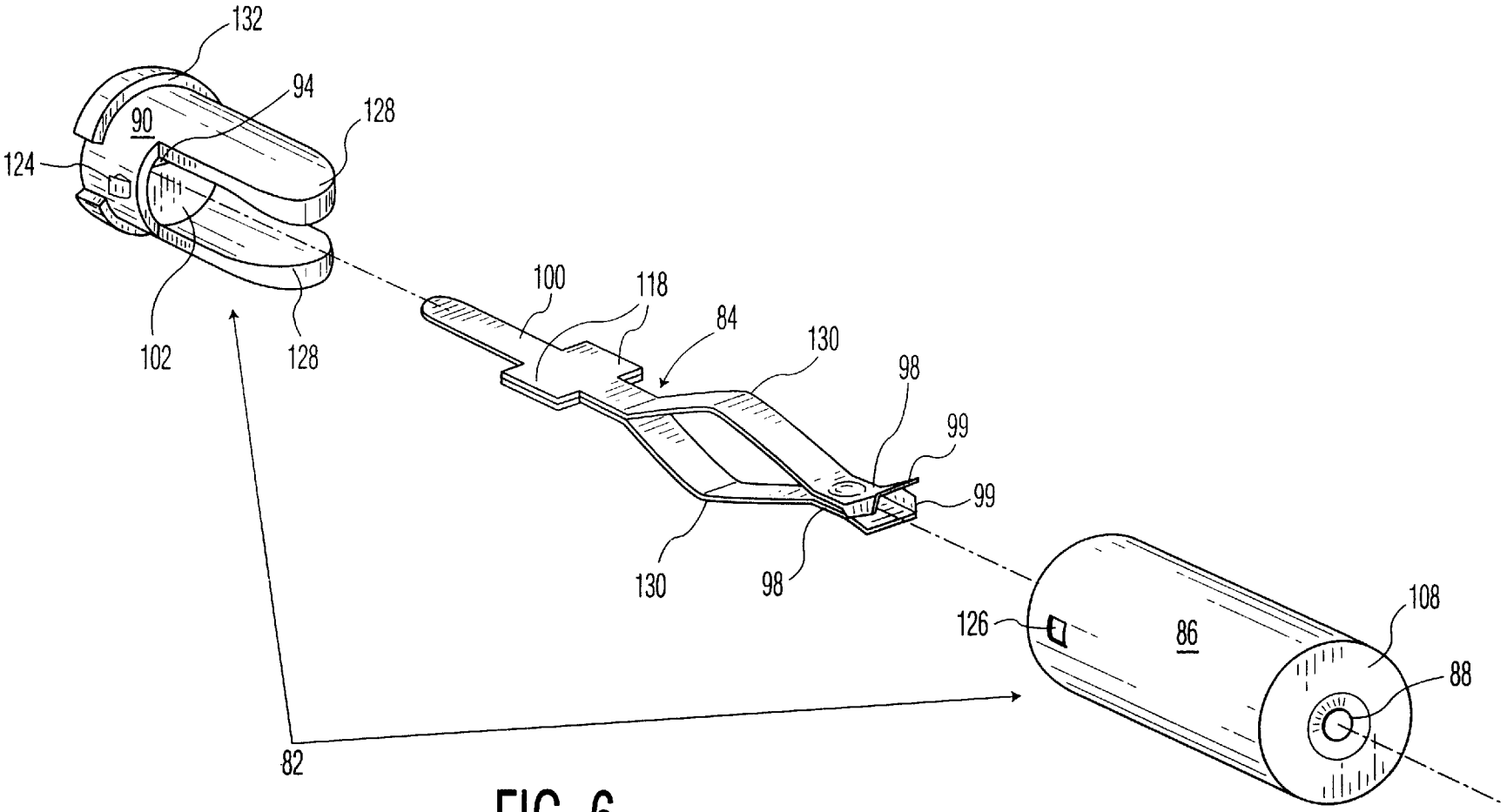
FIG. 6 is an exploded assembly diagram of the internal components of the F-connector assembly of one embodiment of the present invention.

Referring now to FIGS. 5 and 6, the upper cap member 86 and the lower cap member 90 each include a stepped portion 114 and 116, respectively. The stepped portions 114 and 116 cooperate with a pair of opposing tabs 118 located approximately at a mid-portion of the clip pin 84 for securely retaining clip pin 84 within the chamber 92 of the cap assembly forming an inner housing 82. The bottom of the stepped portion 114 of the upper cap member 86 abuts against a top edge 120 of the tabs 118 and the top of the stepped portion 116 of the lower cap member 90 abuts against a bottom edge 122 of the tabs 118. The opposing tabs 118 prevent the clip pin 84 from moving downward relative to the input opening 88 when a downward force is applied by the entering center conductor of a coaxial cable, in that the tabs 118 are abutted against the stepped portion 116 of the lower cap member 90. Also the clip pin 84 is prevented from moving upward due to a force applied by the exiting center conductor, in a similar manner, in that the tabs 118 are abutted against the stepped portion 114 of the upper cap member 86.

To overcome the problems encountered by the prior ant F-connector assembly, the F-connector assembly 60 of the present invention further includes a pair of opposing locking tabs 124 located on each side of the lower cap member 90 and a pair of corresponding locking slots 126 located on each side of the upper cap member 86. The locking tabs 124 are each configured for securely snapping into and being retained by the respective slots 126. In this manner, the coupled slots 126 and tabs 124 locks the upper and lower cap members 86 and 90 together for forming a unitary electrically insulated inner housing 82. With this configuration, the various components are internally secured within the outer shell 62 after the tail portion 100 of the clip pin 84 is soldered via solder 106 either into the terminal slot 104 for the embodiment of FIG. 4, or via a soldered electrical wire conductor 105 between tail portion 100 and a terminal tab 42 on printed circuit board 80 for the embodiment of FIG. 5.

With reference to FIG. 6, a pictorial assembly view of the components of the inner housing 82 and the clip pin 84 is shown. The lower cap member 90 includes a pair of guide ears 128 extending away from the side portions 102 each on opposite sides of the slot 94 (see FIG. 7C). The tail portion 100 of the clip pin 84 is introduced through the slot 94. The clip pin 84 is oriented in a manner wherein each of the guide ears 128 contacts a rear extended portion 130 of the clip pin spring contacts 98 (see FIG. 4). The upper and lower cap members 86 and 90, respectively, are oriented so that the locking tabs 124 are in line with the locking slots 126, and the guides ears 128 of the lower cap member 90 are inserted into channels 144 (see FIGS. 8B, 8C, and 8D) of the upper cap member 86 until the bottom of the upper cap member 86 contacts a base flange 132 of the lower cap member 90. The locking tab 124 and locking slots 126 are engaged for a secure attachment therebetween.

Figure 7A:
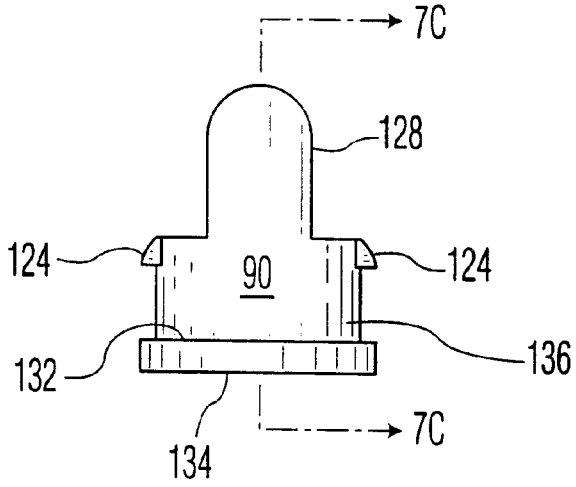
FIG. 7A is a side elevational view of a base retainer of the F-connector assembly of FIG. 6, the opposite side being identical thereto.
Figure 7B:
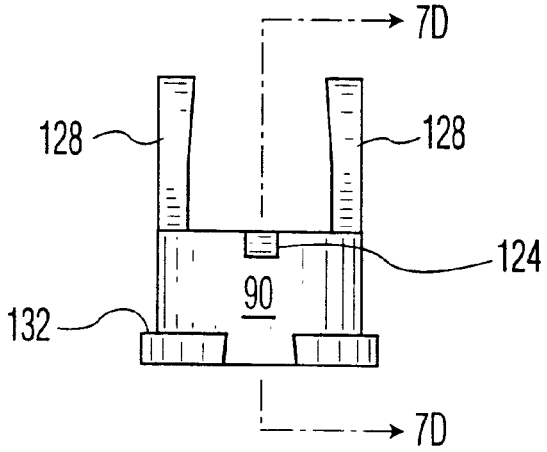
FIG. 7B is a front elevational view of the base retainer of FIG. 7A, the rear elevational view thereof being identical thereto.
Figure 7C:
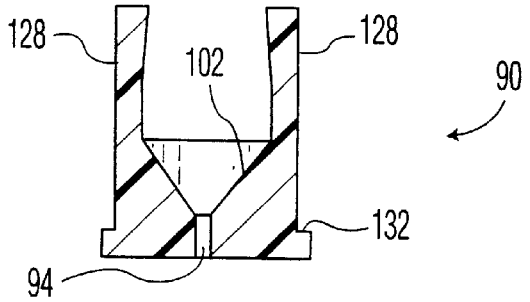
FIG. 7C is a longitudinal cross sectional view of the base retainer taken along 7C—7C of FIG. 7A.
Figure 7D:
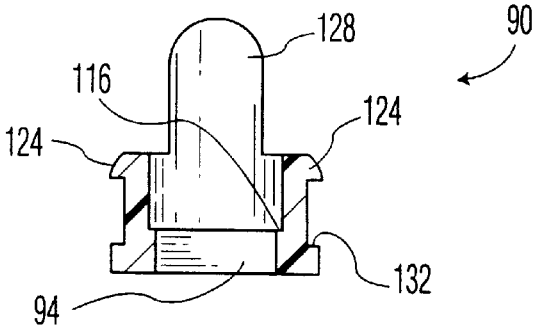
FIG. 7D is a longitudinal cross sectional view of the base retainer taken along 7D—7D of FIG. 7B.
Figure 7E:
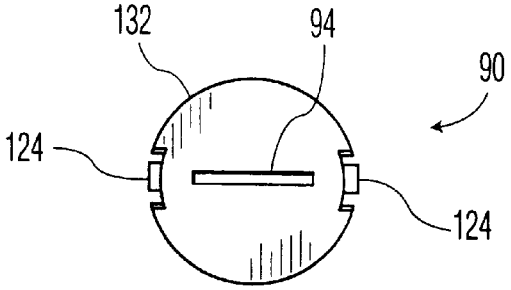
FIG. 7E is a bottom plan view of the retainer base of FIG. 7A.
Figure 8A:
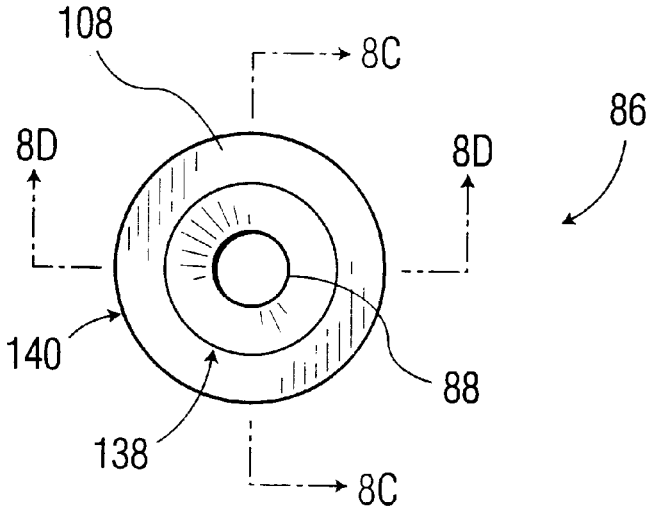
FIG. 8A is a top plan view of a cap member of the F-connector assembly of the present invention.
Figure 8B:
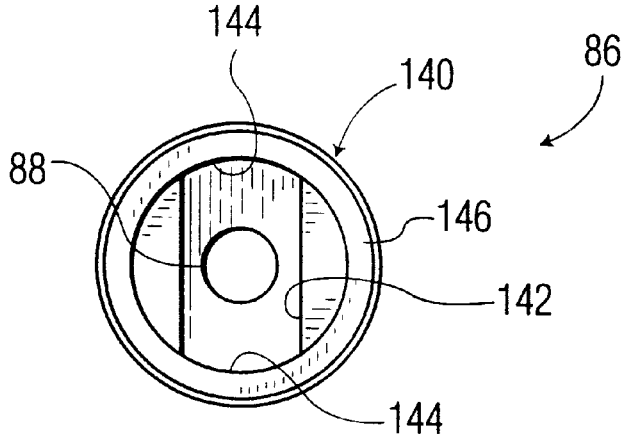
FIG. 8B is a bottom plan view of the cap member of FIG. 8A.
Figure 8C:
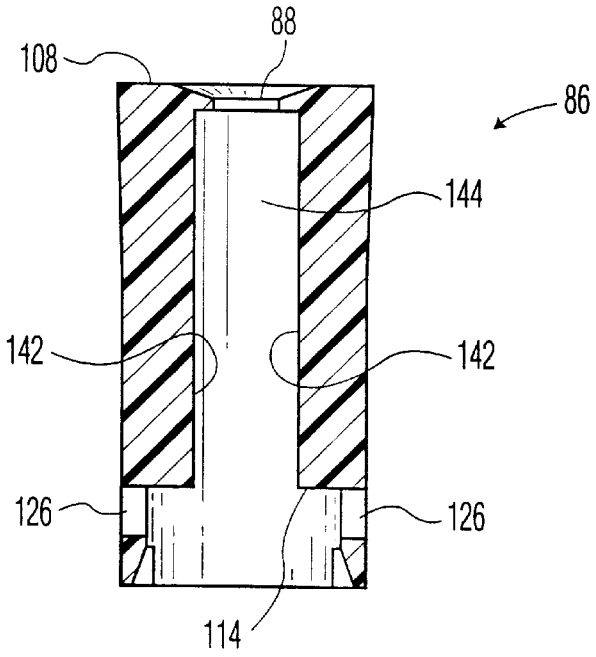
FIG. 8C is a longitudinal cross sectional view of the cap member taken along 8C—8C of FIG. 8A.
Figure 8D:
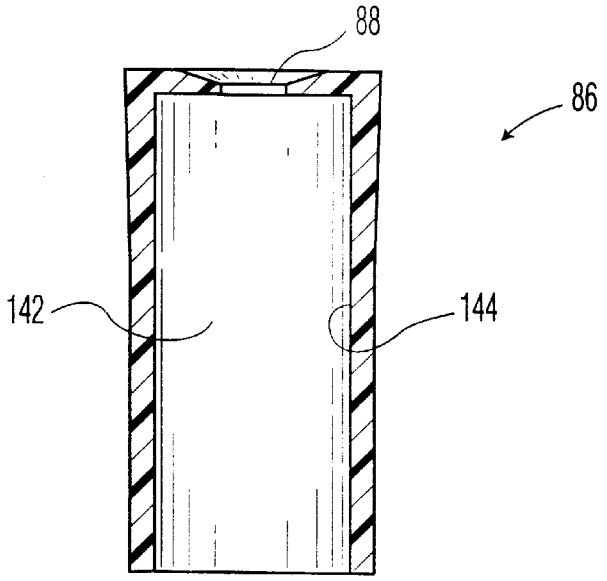
FIG. 8D is a longitudinal cross sectional view of the cap member taken along 8D—8D of FIG. 8A.
Figure 9A:
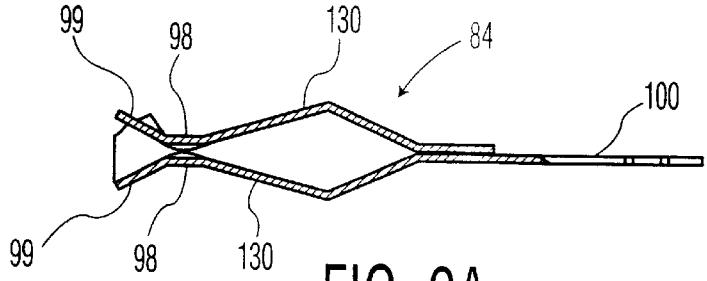
FIG. 9A shows a side elevational view of a clip pin for a preferred embodiment of the invention.
Figure 9B:
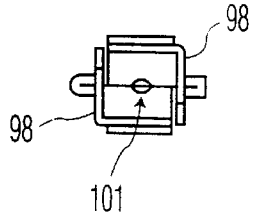
FIG. 9B shows a top plan view of the clip pin of FIG. 9A.
Figure 9C:
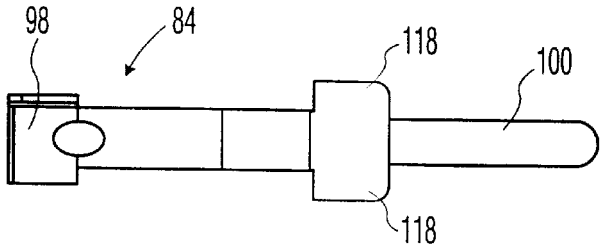
FIG. 9C shows a front elevational view of the clip pin.
Figure 9D:
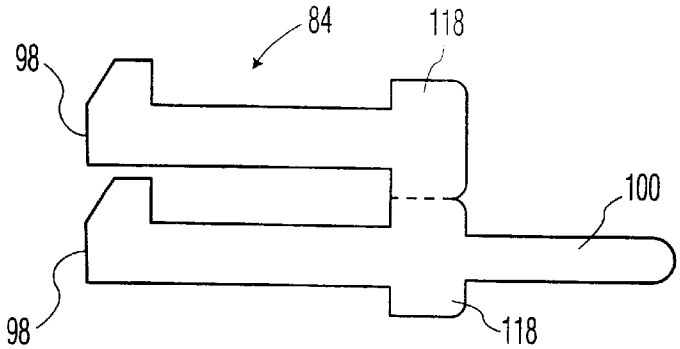
FIG. 9D shows a metal stamping for the clip pin.

With reference to FIGS. 7A through 7E, the design of the lower cap member 90 is shown in detail. The lower cap member 90 includes a circular base 134 and a circumferential side wall 136 with a pair of opposing locking tabs 124 disposed thereon. The pair of opposing guide ears 128 extend upwardly from the sidewall 136. The base flange 132 projects substantially along the periphery of the base 134 for preventing the lower cap member 90 from being inserted into the upper cap member 86. As shown in FIG. 7C (cross section from FIG. 7A), the interior lower side portions 102 converge downwardly toward the slot 94 for guiding and thereby permitting entry of the clip pin 84 end prong 100 therethrough (FIG. 9A).

FIGS. 8A through 8D, show design details for the upper cap member 86. The upper cap member 86 includes an upper circular top face 138 with the centrally located beveled hole 88 for permitting entry of the center pin of the male coaxial cable connector. The beveled hole 88 is concentric with an outer flat top portion 108. The upper cap member 86 further includes a cylindrical outer sidewall 140 extending from the periphery of the top face 138, and a pair of opposing and parallel inside wall portions 142. The parallel inside wall portions 142 form a pair of opposing channels 144 which are configured for sliding engagement with the guide ears 128 of the lower cap member 90 (See FIG. 7C), thereby preventing rotation therebetween. The guide ears 128 and the wall portions 142 also provide indexing for the correct manner of orientation of the cap members 86 and 90, respectively. A peripheral band 146 extends along the base 148 of the upper cap member 86. Once the locking tabs 128 are engaged with the slots 126, the cap members 86 and 90, respectively are rigidly and securely held together to form the inner housing 82 (as shown in FIGS. 4 and 5) as a single unitary piece with the clip pin 84 securely housed therein.

Figure 10:
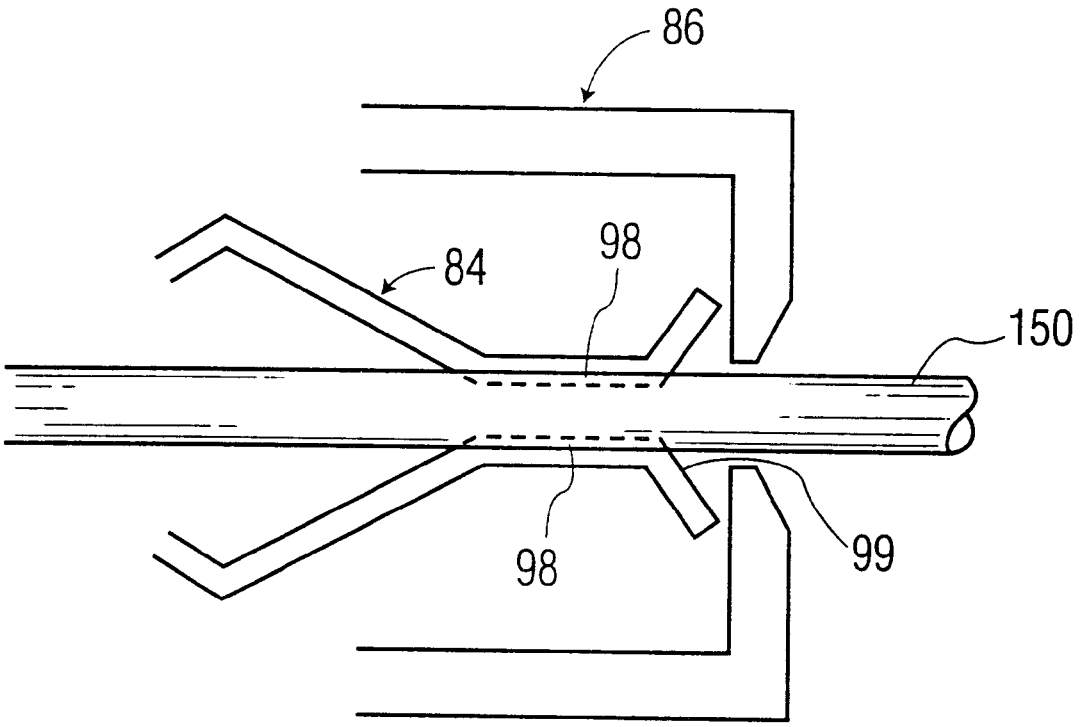
FIG. 10 shows a simplified pictorial view for a preferred embodiment of the invention.

A preferred embodiment for clip pin 84 is shown in FIGS. 9A through 9D. As shown, the front of clip pin 84 includes L-shaped outwardly bent ears 99 for guiding a coaxial cable center conductor end into engagement between contacts 98. The inside surfaces 101 of contacts 98 are curved inward (see FIG. 10) to maximize mechanical and electrical contact with the center conductor 150. The clip pin 84 is formed via appropriate bending of the single piece clip pin metal stamping shown in FIG. 9D. Note that the length of the tab 100 can be varied for the requirements of different applications.

Although various embodiments of the invention have been shown and described, they are not meant to be limiting. Those of skill in the art may recognize various modifications to these embodiments, which modifications are meant to be covered by the spirit and scope of the appended claims.

What is claimed is:

1. A female connector assembly for a coaxial cable, comprising:

a cylindrically shaped body having a top end with a centrally located hole forming an input port and a bottom end configured for connecting with a portion of a housing of an electrical device, said body being configured for mechanical retainment and electrical connection with a coaxial cable connecting element;

a top cap and a bottom cap each consisting of electrically insulative material, and each configured for locking engagement to form a hollow enclosed sleeve, said sleeve being disposed within said body, said hollow enclosed sleeve including a first opening coaxially positioned with said top end hole, a second opening on the opposing end in communication with an interior volume of said housing and a hollow core therebetween; and an electrically conductive clip pin securely retained within the hollow core of said hollow enclosed sleeve, said clip pin including a contact mechanism at one end for receiving, electrically contacting, and retaining a coaxial cable center conductor passing through the open end of said port, and an elongated pin at an opposing end, extending through the second opening of the hollow sleeve into said housing interior volume for rigid mechanical retaimnent and electrical connection to electrical circuitry therein.

2. A female connector assembly for a coaxial cable, comprising:

an outer housing;

a port formed from a portion of said housing having an interior volume, said port including an open end being configured for coupling with a mating coaxial cable connector, and an inside cavity between the open end of the port and the interior volume of the housing;

a hollow sleeve being disposed within the inside cavity of said port, said hollow sleeve including a first opening in communication with the open end of said port and a second opening in communication with said housing interior volume, and a hollow core between the first and second openings;

an electrically conductive clip pin securely retained within the hollow core of said hollow sleeve, said clip pin including a contact mechanism at one end for receiving, electrically contacting, and retaining a coaxial cable center conductor passing through the open end of said port, and an elongated pin at an opposing end, extending from the hollow core through the second opening of the hollow sleeve into said housing interior volume; and means for securing a portion of the pin within the housing interior volume to rigidly retain the hollow sleeve within the inside cavity of the port.

3. The assembly of claim 2 wherein said hollow sleeve further comprises:

a cap having a cavity, a first portion with a centrally located hole for receiving the center conductor of a coaxial cable, a second portion extending from said first portion, having an open opposing end, and a pair of opposing tab slots disposed in said second portion proximate the open end; and a base retainer located in the port below said cap, having a cavity, a first portion with a centrally located bottom hole for permitting passage of the pin therethrough, and a second portion extending from the first portion, said second portion being configured to fit within the second portion of said cap, and a pair of opposing tabs disposed on the second portion, being configured for locking engagement with the opposing tab slots of said cap.

4. The assembly of claim 2, wherein the securing means includes a mechanical and electrical rigid connection between said pin and an electrical lead of electrical circuitry within said housing.

5. The assembly of claim 4, wherein the mechanical and electrical connection is a weld or a solder joint.

6. The assembly of claim 5, wherein said electrical circuitry includes a slot port configured for receiving, electrically contacting, and retaining the elongated pin of said clip pin.

7. The assembly of claim 2, wherein the conductive material of said clip pin is selected from the group consisting of beryllium copper, and phosphor bronze.

8. The assembly of claim 3, wherein said cap and said base retainer each consist of electrically insulative material.

9. The assembly of claim 8, wherein the insulating material of said cap and said base retainer is a plastic material.

10. The assembly of claim 3, wherein the cap further comprises:

a top face portion with a centrally located hole;

a downwardly depending sidewall portion extending from said top face portion; and a pair of opposing parallel interior wall portions disposed within said side wall portion for forming a pair of opposing longitudinal channels therebetween.

11. The assembly of claim 10, wherein the base retainer further comprises:

a base portion having a centrally located slot;

a sidewall portion extending upwardly from said base portion and being configured for fitting engagement into an interior space of said cap; and a pair of opposing guide ears extending from said sidewall portion and being configured for sliding engagement into the corresponding longitudinal channels of said cap.

12. The assembly of claim 2 wherein said contact mechanism of said clip pin further comprises a pair of opposing spring fingers at one end, with first and second electrical contacts for receiving an end portion of a center conductor of a coaxial cable therebetween.

13. The assembly of claim 2 wherein the open end of the port further includes a substantially flat top surface portion extending around and concentric with a central opening thereof for providing a flush face for electrical contact with a mating connector.

14. The assembly of claim 13, wherein the diameter of the opening at the open end of said port is made smaller than the outside diameter of said hollow sleeve.

* * * * *